US011534779B2

(12) United States Patent
Hung et al.

(10) Patent No.: US 11,534,779 B2
(45) Date of Patent: Dec. 27, 2022

(54) SPRAYING APPARATUS HAVING HELICAL GROOVE

(71) Applicant: FLAWLESS CONCEPTS TECHNOLOGY INTERNATIONAL CORPORATION, Taipei (TW)

(72) Inventors: Chih-Hung Hung, New Taipei (TW); Jeffrey Lee Brown, Taipei (TW)

(73) Assignee: FLAWLESS CONCEPTS TECHNOLOGY INTERNATIONAL CORPORATION, Taipei (TW)

( * ) Notice: Subject to any disclaimer, the term of this patent is extended or adjusted under 35 U.S.C. 154(b) by 96 days.

(21) Appl. No.: 17/061,429

(22) Filed: Oct. 1, 2020

(65) Prior Publication Data

US 2022/0062928 A1 Mar. 3, 2022

(30) Foreign Application Priority Data

Sep. 3, 2020 (TW) ..... 109211523

(51) Int. Cl.
*B05B 7/04* (2006.01)
*B05B 7/24* (2006.01)
*B05B 7/00* (2006.01)

(52) U.S. Cl.
CPC ..... *B05B 7/0408* (2013.01); *B05B 7/0018* (2013.01); *B05B 7/2443* (2013.01)

(58) Field of Classification Search
CPC ..... B05B 7/30; B05B 7/0408; B05B 12/1409; B05B 15/63; B05B 7/2472; B05B 7/2443; B01F 25/31231; B01F 25/31243; B01F 25/316; B67D 7/0277; B67D 7/0288; B67D 7/741; B67D 7/423
See application file for complete search history.

(56) References Cited

U.S. PATENT DOCUMENTS 2,246,211 A * 6/1941 Kilich ..... B05B 7/10 239/10
2,965,309 A * 12/1960 Parrott ..... B05B 7/2443 239/426
3,032,275 A * 5/1962 Schneider ..... B05B 7/30 239/592
3,940,069 A * 2/1976 Gunzel, Jr ..... B05B 7/2443 239/394

(Continued)

*Primary Examiner* — Vishal Pancholi
(74) *Attorney, Agent, or Firm* — Muncy, Geissler, Olds & Lowe, P.C.

(57) ABSTRACT

A spraying apparatus, used for connecting a high-pressure liquid supply device to receive a high-pressure liquid conveyed by the high-pressure liquid supply device, includes a container, a delivery pipe, a liquid-mixing fitting, a pressurized fitting and a foam-generating element. The container, used for accommodating a detergent. The liquid-mixing fitting is connected with the high-pressure liquid supply device. When the high-pressure liquid flows by, the detergent is inhaled to the liquid-mixing fitting via the delivery pipe to mix the high-pressure liquid for forming a detergent mixture. An inner wall of the pressurized fitting is furnished with at least one helical groove for pressurizing the detergent mixture to form a pressurized detergent mixture. As the pressurized detergent mixture flows by the foam-generating element, a plurality of cleaning foams are formed for enhance cleaning effect.

7 Claims, 10 Drawing Sheets

(56) References Cited

U.S. PATENT DOCUMENTS

| | | | | |
|---|---|---|---|---|
| 3,964,689 | A * | 6/1976 | Horvath, Jr. | B05B 7/2443 239/432 |
| 4,878,619 | A * | 11/1989 | Norman | B05B 7/2443 239/335 |
| 5,195,664 | A * | 3/1993 | Rhea | B05B 11/0059 222/464.6 |
| 6,708,901 | B2 * | 3/2004 | Hubmann | B05B 1/3013 239/398 |
| 9,199,256 | B2 * | 12/2015 | Jia | B05B 7/0408 |
| 9,919,347 | B2 * | 3/2018 | Haworth | B08B 3/02 |
| 2008/0054098 | A1 * | 3/2008 | Dodd | B05B 7/2443 239/310 |
| 2008/0068923 | A1 * | 3/2008 | Pitrolffy | B01F 35/712 366/164.1 |
| 2013/0193226 | A1 * | 8/2013 | Uschold | B05B 7/0408 239/407 |

* cited by examiner

SPRAYING APPARATUS HAVING HELICAL GROOVE

This application claims the benefit of Taiwan Patent Application Serial No. 109211523, filed Sep. 3, 2020, the subject matter of which is incorporated herein by reference.

BACKGROUND OF THE INVENTION

(1) Field of the Invention

The invention relates to an apparatus, and more particularly to a spraying apparatus having at least one helical groove.

(2) Description of the Prior Art

In daily life, while people clean or maintain their cars, water is usually firstly sprayed onto the car for largely removing dust or sand thereon. Then, cleaning foam would be used to further remove oils on the car. Preferably, a layer of wax will be applied to the car before the entire cleaning and maintenance work can be completed.

Generally, degree of foaming, tightness and fineness of the cleaning foam are crucial factors toward a successful cleaning task. However, though formulation methods of the cleaning foam are already various to provide versatile cleaning effects, yet rooms for improving existing formulation methods of the cleaning foam are always there.

SUMMARY OF THE INVENTION

In view that different formulation methods of the cleaning foam can only provide specific cleaning effect, thus a perfect cleaning task can be never assured. Accordingly, it is an object of the present invention to provide a spraying apparatus, which has at least one helical groove for resolving at least one of the aforesaid shortcomings described above.

According to the present invention, a spraying apparatus, used for connecting a high-pressure liquid supply device and thus receiving a high-pressure liquid delivered by a high-pressure pipe of the high-pressure liquid supply device, includes a container, a delivery pipe, a liquid-mixing fitting, a pressurized fitting and a foam-generating element. The container, used for accommodating a detergent, has an accommodation space. The delivery pipe, disposed in the container, extends into the detergent, and has a delivery channel. The liquid-mixing fitting, having a mixing channel connected with the high-pressure pipe and the delivery channel, is further connected to the accommodation space via the delivery channel, and used for inhaling the detergent from the accommodation space and then conveying to the mixing channel via the delivery channel upon when the high-pressure liquid flows through the mixing channel, so that the detergent can mix the high-pressure liquid to form a detergent mixture. The pressurized fitting has an inner wall for defining thereinside a pressurizing channel connected with the mixing channel, and the inner wall is furnished with at least one helical groove for pressurizing the detergent mixture to form a pressurized detergent mixture. The foam-generating element, connected with the pressurized fitting, is used for forming a plurality of cleaning foams upon when the pressurized detergent mixture flows by.

In one embodiment of the present invention, the inner wall has a tapered section and a straight section orderly arranged in a pressuring direction, and the tapered section is furnished with the at least one helical groove.

In one embodiment of the present invention, the inner wall has a tapered section and a straight section orderly arranged in a pressuring direction, and the straight section is furnished with the at least one helical groove.

In one embodiment of the present invention the inner wall has a tapered section and a straight section orderly arranged in a pressuring direction, and each of the tapered section and the straight section is furnished with the at least one helical groove.

In one embodiment of the present invention, the foam-generating element includes a steel wool.

In one embodiment of the present invention, the spraying apparatus further includes a fluid-directing assembly, fluid-directing assembly connected with the foam-generating element for limiting a spray direction of the plurality of cleaning foams.

In one embodiment of the present invention, the spraying apparatus further includes a weight-balancing assembly disposed at a lower end of the delivery pipe, used for bending the delivery pipe in a gravity direction upon when the spraying apparatus is inclined, so as to maintain the lower end of the delivery pipe in the detergent.

In one embodiment of the present invention, the at least one helical groove is at least one rifling groove.

In one embodiment of the present invention, the at least one helical groove is at least one thread groove.

As stated, the spraying apparatus provided by the present invention utilizes the pressurized fitting furnished thereinside with the helical grooves to pressurize and also accelerate the detergent mixture for further forming the pressurized detergent mixture. Then, the foam-generating element is applied to transform the pressurized detergent mixture into the desired cleaning foam. In comparison to the prior art, the present invention can produce a denser and more meticulous cleaning foams from the pressurized detergent mixture, such that the entire cleaning effect can be enhanced.

All these objects are achieved by the spraying apparatus described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a spraying apparatus. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
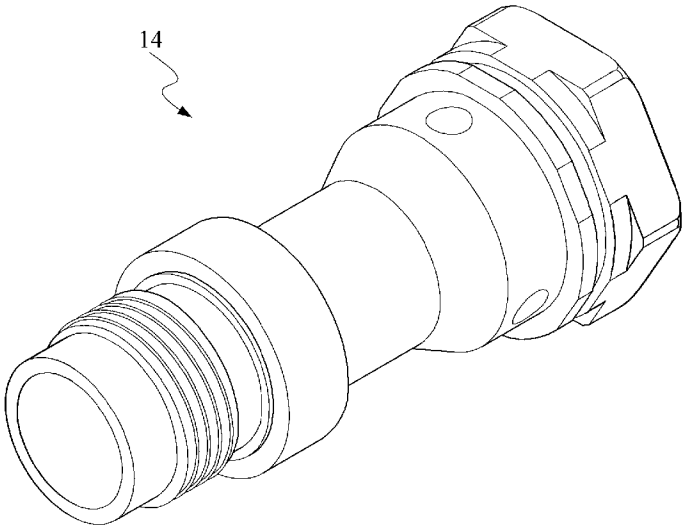
FIG. 1 is a schematic perspective view of a pressurized fitting for a first embodiment of the spraying apparatus in accordance with the present invention.
Figure 2:
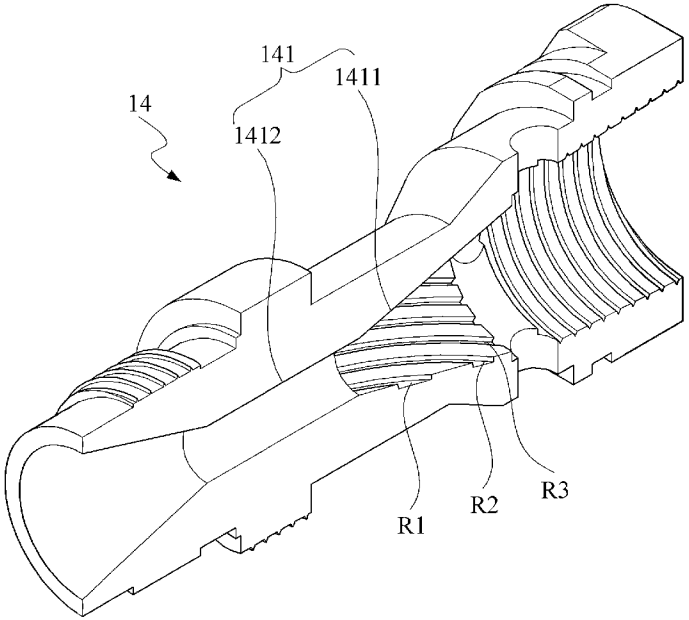
FIG. 2 is a schematic perspective cross-sectional view of FIG. 1.
Figure 3:
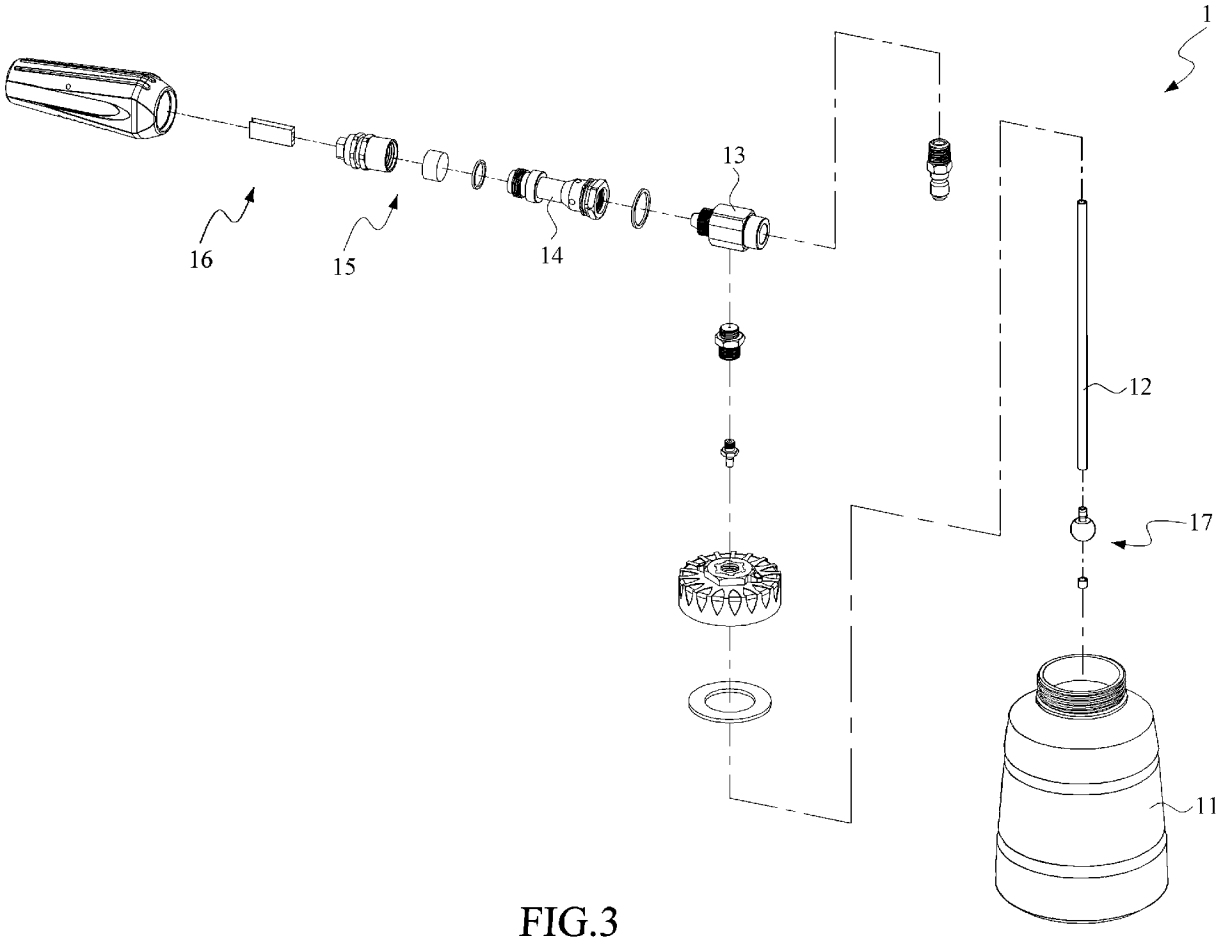
FIG. 3 is a schematic exploded view of the first embodiment of the spraying apparatus of the present invention.
Figure 4:
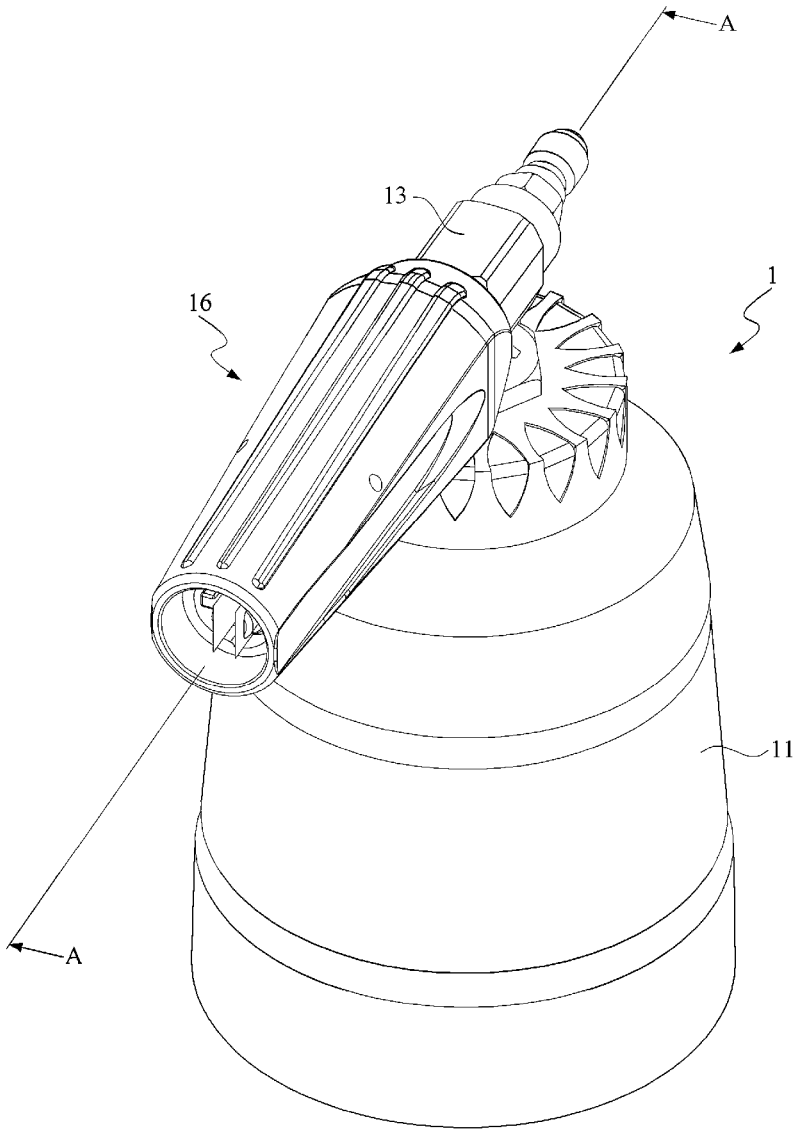
FIG. 4 is a schematic perspective view of FIG. 3.
Figure 5:
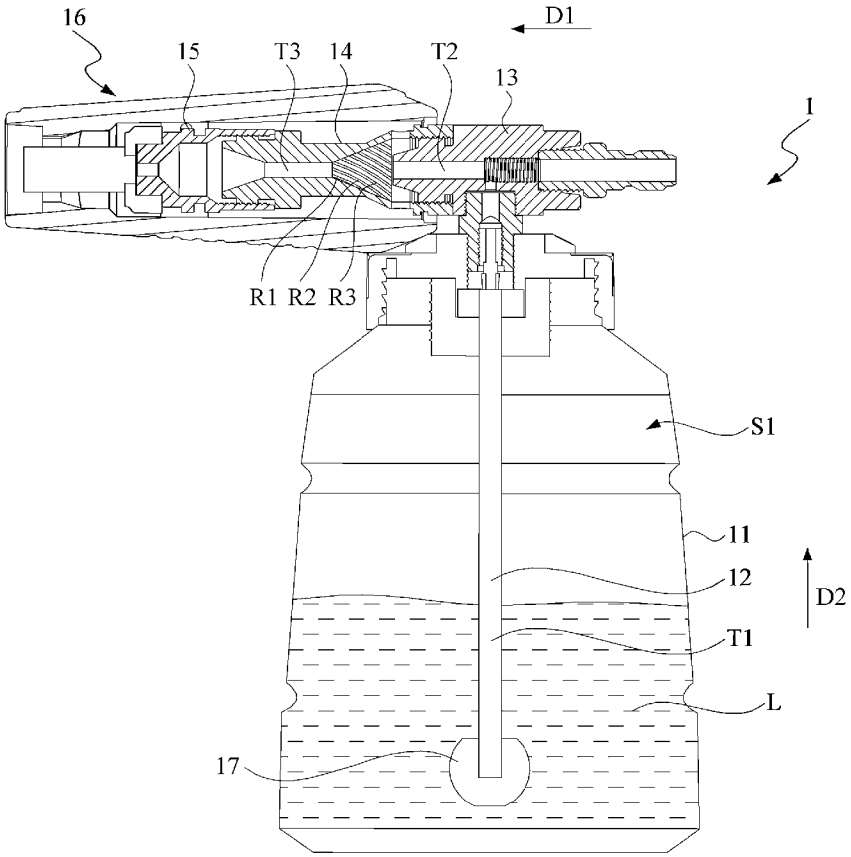
FIG. 5 is a schematic cross-sectional view of FIG. 4 along line A-A.

Refer to FIG. 1 through FIG. 5; where FIG. 1 is a schematic perspective view of a pressurized fitting for a first embodiment of the spraying apparatus in accordance with the present invention, FIG. 2 is a schematic perspective cross-sectional view of FIG. 1, FIG. 3 is a schematic exploded view of the first embodiment of the spraying apparatus of the present invention, FIG. 4 is a schematic perspective view of FIG. 3, and FIG. 5 is a schematic cross-sectional view of FIG. 4 along line A-A. As shown, the spraying apparatus 1 includes a container 11, a delivery pipe 12, a liquid-mixing fitting 13, a pressurized fitting 14 and a foam-generating element 15.

The pressurized fitting 14 has an inner wall 141 furnished with at least one helical groove. In this embodiment, the inner wall 141 has a tapered section 1411 and a straight section 1412 orderly arranged in a pressuring direction D1. The tapered section 1411 is furnished with a plurality of helical grooves (6 shown in the figure, and 3 thereof labeled with R1, R2, R3, respectively). It is noted that extension of each individual helical groove is not parallel to the pressuring direction D1.

The container 11 has an accommodation space S1 for containing a detergent L. The delivery pipe 12, disposed in the container 11 and extended into the detergent L, has a delivery channel T1. The liquid-mixing fitting 13, connected with the delivery pipe 12, has a mixing channel T2 connected to the delivery channel T1 and then further to the accommodation space S1.

The pressurized fitting 14, connected with the liquid-mixing fitting 13, provides the inner wall 141 thereinside to define a pressurizing channel T3 to connect spatially the mixing channel T2. The foam-generating element 15 is connected with the pressurized fitting 14. In this embodiment, the foam-generating element 15 includes, but not limited to, a steel wool. In some other embodiments, the foam-generating element 15 can include other rigid porous materials.

In addition, in this embodiment, the spraying apparatus 1 further includes a fluid-directing assembly 16 and a weight-balancing assembly 17. The fluid-directing assembly 16 is connected with the foam-generating element 15, and the weight-balancing assembly 17 is disposed at a lower end of the delivery pipe 12.

Figure 6:
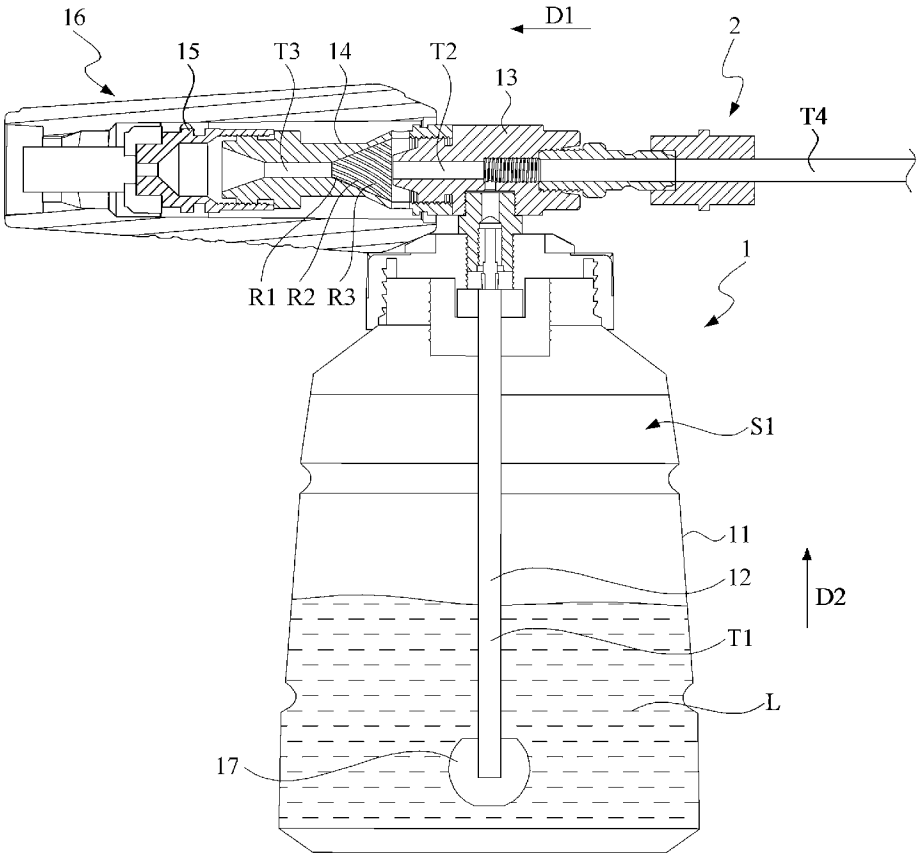
FIG. 6 is a schematic view of the first embodiment of the spraying apparatus connected with a high-pressure liquid supply device.
Figure 7:
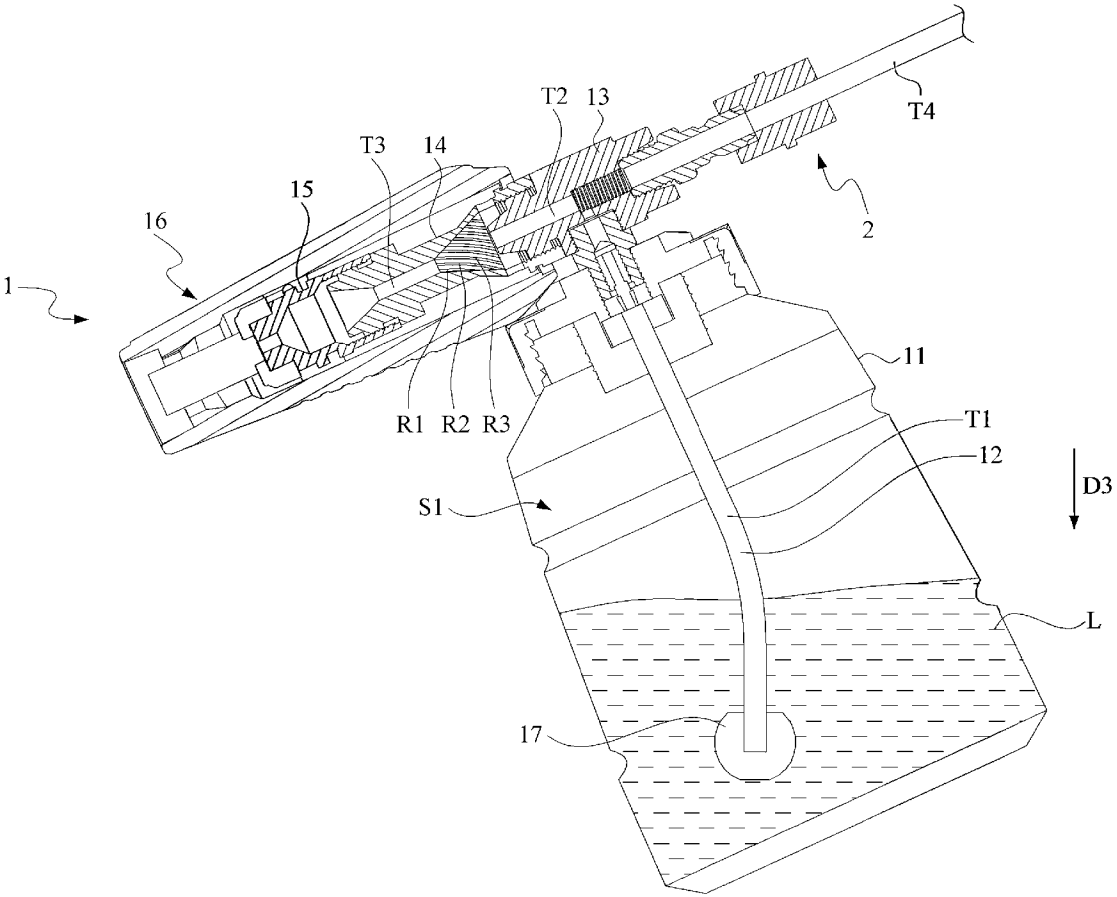
FIG. 7 demonstrates schematically an oblique view of FIG. 6.

Then, refer together to FIG. 1 through FIG. 7; where FIG. 6 is a schematic view of the first embodiment of the spraying apparatus connected with a high-pressure liquid supply device, and FIG. 7 demonstrates schematically an oblique view of FIG. 6. As shown, the spraying apparatus 1 is connected with a high-pressure liquid supply device 2 to receive a high-pressure liquid conveyed via a high-pressure pipe T4 of the high-pressure liquid supply device 2.

The mixing channel T2 of the liquid-mixing fitting 13, connected with the delivery channel T1 of the delivery pipe 12, is also connected to the high-pressure pipe T4. Thus, as the high-pressure liquid flows from the high-pressure pipe T4 into the mixing channel T2, a pressure difference would be formed to inhale the detergent L from the accommodation space S1 to the mixing channel T2 via the delivery channel T1. Namely, the detergent L would be flowed to the mixing channel T2 in a inhaling direction D2.

As the detergent L enters the mixing channel T2, it will mix with the high-pressure liquid to form a detergent mixture. Since the high-pressure liquid is kept delivering into the spraying apparatus 1, the detergent mixture would keep flowing in the pressuring direction D1. When the detergent mixture passes through the pressurized fitting 14, flows of the detergent mixture would be affected by the helical grooves R1, R2, R3 so as to be pressurized for forming a pressurized detergent mixture. The helical grooves R1, R2, R3 are structurally resembled to the rifling structure in the gun barrel, such that the detergent mixture can be accelerated.

Then, when the pressurized detergent mixture flows through the foam-generating element 15, a plurality of cleaning foams can be formed. Since the pressurized detergent mixture can be pressurized and accelerated by the helical grooves R1, R2, R3, the cleaning foams would be much denser and more meticulous by compared to the prior art, such that the cleaning effect can be enhanced.

In this embodiment, the fluid-directing assembly 16 would further limit a spray direction of the cleaning foam. If an open direction of the fluid-directing assembly 16 is a horizontal direction, the spray direction of the cleaning foam would follow the horizontal direction. If the opening direction of the fluid-directing assembly 16 is a vertical direction, then the spray direction of the cleaning foam would be the vertical direction. Thereupon, convenience and mobility of this apparatus would be substantially enhanced.

In addition, while the spraying apparatus 1 is in use, the upright position as shown in FIG. 5 or FIG. 6 is not always the operation state. For some application environments, the spraying apparatus 1 may pose at an inclined state, for example, as shown in FIG. 7, in which the detergent L in the container 11 would demonstrate a slop with respect to the container 11. As such, it is possible that the delivery pipe 12 might meet a situation of being unable to dip into the detergent L, and then no cleaning foam would be formed. To overcome this embarrassed situation, the spraying apparatus 1 of this invention is further furnished with the weight-balancing assembly 17.

The weight-balancing assembly 17, disposed at the lower end of the delivery pipe 12, has a predetermined weight. While the spraying apparatus 1 is inclined, the weight-balancing assembly 17 would move down in a gravity direction D3. That is, the delivery pipe 12 would be pulled down and be bent toward in the gravity direction D3, such that the delivery pipe 12 can be extended and dipped into the detergent L. Thereupon, the aforesaid shortcoming in failing to generate the cleaning foam can be resolved.

Figure 8:
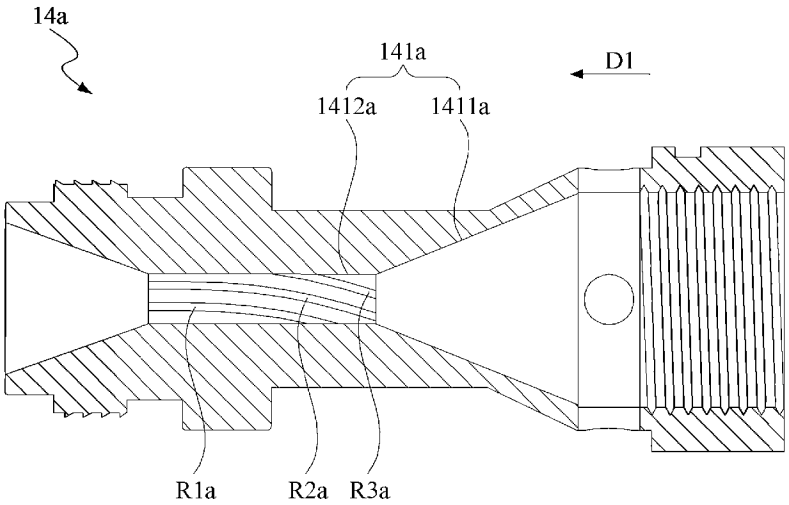
FIG. 8 is a schematic cross-sectional view of another pressurized fitting for a second embodiment of the spraying apparatus in accordance with the present invention.

Then, referring to FIG. 8, a schematic cross-sectional view of another pressurized fitting for a second embodiment of the spraying apparatus in accordance with the present invention is shown. It shall be explained that the only difference between this second embodiment and the previous first embodiment is at the pressurized fitting 14*a*. Thus, in describing the second embodiment as follows, only the pressurized fitting 14*a* would be elucidated.

As shown, the pressurized fitting 14*a* has an inner wall 141*a*, and the inner wall 141*a* has a tapered section 1411*a* and a straight section 1412*a* orderly arranged in a pressuring direction D1.

In this embodiment, the straight section 1412*a* of the inner wall 141*a* is furnished with a plurality of helical grooves (3 labeled with R1*a*, R2*a* and R3*a* in the figure, respectively). In this pressurized fitting 14*a*, since the straight section 1412*a* of the inner wall 141*a* is furnished with the helical grooves R1*a*, R2*a*, R3*a*, thus the detergent mixture can be pressurized and accelerated while passing the helical grooves R1*a*, R2*a*, R3*a*, and so the pressurized detergent mixture can be formed.

Figure 9:
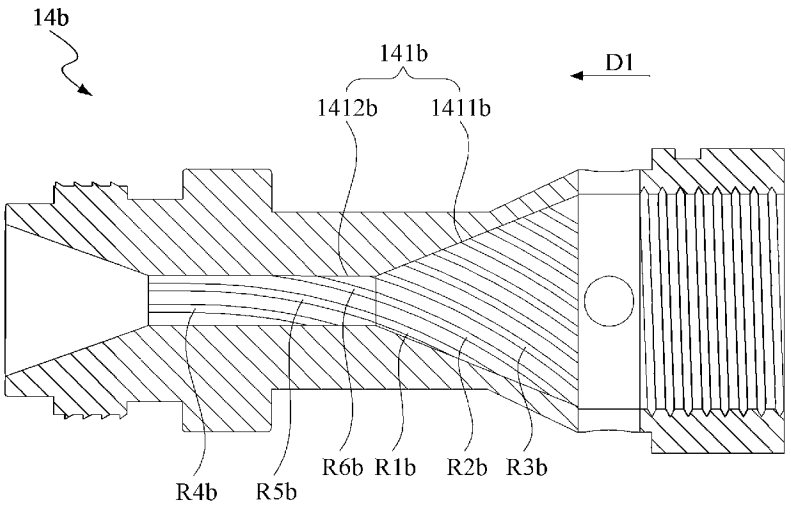
FIG. 9 is a schematic cross-sectional view of a further pressurized fitting for a third embodiment of the spraying apparatus in accordance with the present invention.

Then, referring to FIG. 9, a schematic cross-sectional view of a further pressurized fitting for a third embodiment of the spraying apparatus in accordance with the present invention is shown. It shall be explained that the only difference between this third embodiment and the previous first embodiment is at the pressurized fitting 14*b*. Thus, in describing the third embodiment as follows, only the pressurized fitting 14*b* would be elucidated.

As shown, the pressurized fitting 14*b* has an inner wall 141*b*, and the inner wall 141*b* has a tapered section 1411*b* and a straight section 1412*b* orderly arranged in a pressuring direction D1.

In this embodiment, both the tapered section 1411*b* and the straight section 1412*b* of the inner wall 141*b* are furnished individually with a plurality of helical grooves (labeled as R1*b*, R2*b*, R3*b*, R4*b*, R5*b*, R6*b* in the figure). Since plural helical grooves R1*b*, R2*b*, R3*b*, R4*b*, R5*b*, R6*b* are provided evenly to the tapered section 1411*b* and the straight section 1412*b* of the pressurized fitting 14*b*, thus the detergent mixture can be pressurized and accelerated by the helical grooves R1*b*, R2*b*, R3*b*, R4*b*, R5*b*, R6*b*, so as to form the corresponding pressurized detergent mixture.

It shall be explained that, in this third embodiment, the tapered section 1411*b* is furnished with the helical grooves R1*b*, R2*b*, R3*b*, while the straight section 1412*b* is furnished with the helical grooves R4*b*, R5*b*, R6*b*. In particular, the helical grooves R4*b*, R5*b*, R6*b* are connected spatially with the helical grooves R1*b*, R2*b*, R3*b*, respectively. In some other embodiments, these helical grooves R1*b*, R2*b*, R3*b*, R4*b*, R5*b*, R6*b* may be independent to each other. In the figure of this third embodiment, it shows that the helical grooves R5*b* is connected with the helical grooves R1*b*, and the helical grooves R6*b* is connected with the helical grooves R2*b*.

Figure 10:
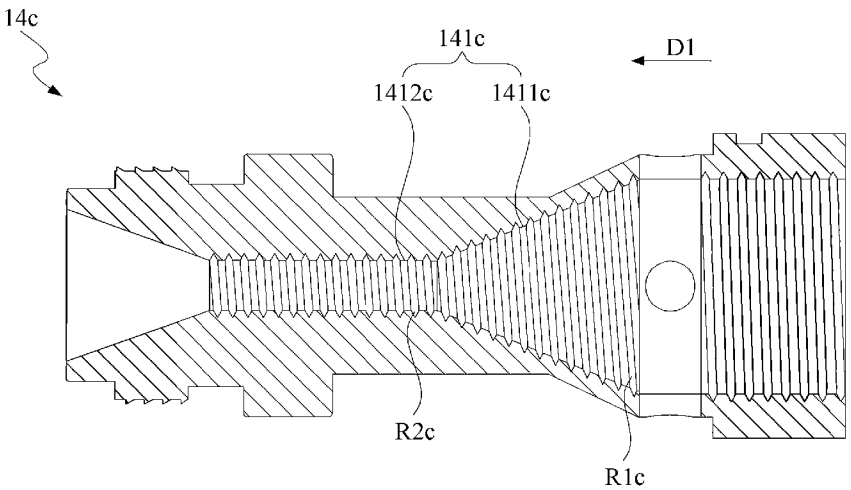
FIG. 10 is a schematic cross-sectional view of one more pressurized fitting for a fourth embodiment of the spraying apparatus in accordance with the present invention.

Finally, referring to FIG. 10, a schematic cross-sectional view of one more pressurized fitting for a fourth embodiment of the spraying apparatus in accordance with the present invention is shown. It shall be explained that the only difference between this fourth embodiment and the previous first embodiment is at the pressurized fitting 14*c*. Thus, in describing the third embodiment as follows, only the pressurized fitting 14*c* would be elucidated.

As shown, the pressurized fitting 14*c* has an inner wall 141*c*, and the inner wall 141*c* has a tapered section 1411*c* and a straight section 1412*c* orderly arranged in a pressuring direction D1.

In this embodiment, both the tapered section 1411*c* and the straight section 1412*c* of the inner wall 141*c* are furnished individually with a plurality of helical grooves (labeled as R1*c*, R2*c* in the figure for example). Since plural helical grooves R1*c*, R2*c*, for example, are provided to the pressurized fitting 14*c* at the tapered section 1411*c* and the straight section 1412*c* of the inner wall 141*c*, thus the detergent mixture can be pressurized and accelerated by the helical grooves R1*c*, R2*c*, so as to form the corresponding pressurized detergent mixture.

It shall be explained that, in this fourth embodiment, the tapered section 1411*c* is furnished with the helical grooves R1*c*, and the straight section 1412*c* is furnished with the helical grooves R2*c*. In particular, the helical grooves R1*c* can be connected spatially with, or dependent to, the helical grooves R2*c*. In FIG. 10, the helical grooves R1*c* are configured schematically to connect the helical grooves R2*c*. Preferably, the helical grooves R1*c*, R2*c* of this embodiment can be thread grooves, while the helical grooves R1, R2, R3, R1*a*, R2*a*, R3*a*, Rib, R2*b*, R3*b*, R4*b*, R5*b*, R6*b* of the first embodiment through the third embodiment are structured to be rifling grooves.

In addition, in some other embodiments of the present invention, the helical grooves can be furnished only to the tapered section of the inner wall, but the straight section thereof is left without any helical groove. Also, in some more other embodiments of the present invention, the helical grooves can be furnished only to the straight section of the inner wall, but the tapered section thereof is left without any helical groove. With any of the aforementioned embodiments, the detergent mixture can be pressurized and accelerated to form the pressurized detergent mixture.

In summary, the spraying apparatus provided by the present invention utilizes the pressurized fitting furnished thereinside with the helical grooves to pressurize and also accelerate the detergent mixture for further forming the pressurized detergent mixture. In comparison to the prior art, the present invention can produce a denser and more meticulous cleaning foams from the pressurized detergent mixture, such that the entire cleaning effect can be enhanced.

While the present invention has been particularly shown and described with reference to a preferred embodiment, it will be understood by those skilled in the art that various changes in form and detail may be without departing from the spirit and scope of the present invention.

What is claimed is:

1. A spraying apparatus, used for connecting a high-pressure liquid supply device and thus receiving a high-pressure liquid delivered by a high-pressure pipe of the high-pressure liquid supply device, comprising:

a container, used for accommodating a detergent, having an accommodation space;

a delivery pipe, disposed in the container, extending into the detergent, having a delivery channel;

a liquid-mixing fitting, having a mixing channel connected with the high-pressure pipe and the delivery channel, further connected to the accommodation space via the delivery channel, used for inhaling the detergent from the accommodation space and then conveying to the mixing channel via the delivery channel upon when the high-pressure liquid flows through the mixing channel, so as to mix the detergent and the high-pressure liquid into a detergent mixture;

a pressurized fitting, disposed downstream to the delivery pipe and having an inner wall for defining thereinside a pressurizing channel connected coaxially with the mixing channel, the inner wall having a leading tapered section, a middle straight section and a tailing nozzle section orderly arranged in a pressuring direction, the leading tapered section being furnished with at least one helical groove for pressurizing the detergent mixture to form a pressurized detergent mixture; and a foam-generating element, connected with the pressurized fitting, used for forming a plurality of cleaning foams upon when the pressurized detergent mixture flows by.

2. The spraying apparatus of claim 1, wherein the middle straight section is furnished with the at least one helical groove.

3. The spraying apparatus of claim 1, wherein the foam-generating element includes a steel wool.

4. The spraying apparatus of claim 1, further including a fluid-directing assembly connected with the foam-generating element for limiting a spray direction of the plurality of cleaning foams.

5. The spraying apparatus of claim 1, further including a weight-balancing assembly disposed at a lower end of the delivery pipe, used for bending the delivery pipe in a gravity direction upon when the spraying apparatus having helical grooves is inclined, so as to maintain the lower end of the delivery pipe in the detergent.

6. The spraying apparatus of claim 1, wherein the at least one helical groove is at least one rifling groove.

7. The spraying apparatus of claim 1, wherein the at least one helical groove is at least one thread groove.

* * * * *